US007430840B2

(12) United States Patent
Osti et al.

(10) Patent No.: US 7,430,840 B2
(45) Date of Patent: Oct. 7, 2008

(54) METHOD AND MACHINE FOR PACKING A PRODUCT IN AT LEAST ONE SHEET OF PACKING MATERIAL

(75) Inventors: Roberto Osti, Zola Predosa (IT); Alessandro Minarelli, Bazzano (IT); Andrea Biondi, Bologna (IT)

(73) Assignee: G.D Societa' per Azioni (IT)

( * ) Notice: Subject to any disclaimer, the term of this patent is extended or adjusted under 35 U.S.C. 154(b) by 0 days.

(21) Appl. No.: 11/539,319

(22) Filed: Oct. 6, 2006

(65) Prior Publication Data

US 2007/0130888 A1 Jun. 14, 2007

(30) Foreign Application Priority Data

Oct. 6, 2005 (IT) ..... BO2005A0595

(51) Int. Cl.
*B65B 19/04* (2006.01)
*B65B 35/30* (2006.01)

(52) U.S. Cl. ..... 53/148; 53/151; 53/225; 53/234

(58) Field of Classification Search ..... 53/444, 53/452, 148, 151, 558, 574, 586, 251, 252, 53/225, 234; 198/426, 427, 429
See application file for complete search history.

(56) References Cited

U.S. PATENT DOCUMENTS 4,150,520 A * 4/1979 Palmieri et al. ..... 53/225
4,330,976 A * 5/1982 Blackall et al. ..... 53/234
4,909,020 A * 3/1990 Focke ..... 53/234
4,936,440 A * 6/1990 Focke et al. ..... 53/234
6,516,811 B1 2/2003 Focke et al.
2002/0185141 A1* 12/2002 Heide ..... 131/281
2007/0079576 A1* 4/2007 Biondi ..... 53/234
2007/0289259 A1* 12/2007 Berluzzi et al. ..... 53/444

FOREIGN PATENT DOCUMENTS

| | | |
|---|---|---|
| EP | 1 065 143 | 1/2001 |
| GB | 1166236 | 10/1969 |
| WO | 03/084354 | 10/2003 |

* cited by examiner

*Primary Examiner*—Louis K Huynh
(74) *Attorney, Agent, or Firm*—Ostrolenk, Faber, Gerb & Soffen, LLP

(57) ABSTRACT

A machine for packing a product in at least one sheet of packing material has a number of conveyors, each of which has a number of pockets, each for receiving and conveying a respective product; the products are transferred from each conveyor to the next conveyor at a transfer station defined between the two conveyors; the pockets on each conveyor are divided into a first number of groups, each containing an equal second number, greater than one, of pockets; and, at each transfer station, a second number of products are transferred simultaneously from the pockets in a group of pockets on the releasing conveyor to the pockets in a group of pockets on the receiving conveyor.

34 Claims, 7 Drawing Sheets

METHOD AND MACHINE FOR PACKING A PRODUCT IN AT LEAST ONE SHEET OF PACKING MATERIAL

The present invention relates to a method and machine for packing a product in at least one sheet of packing material.

The present invention may be used to advantage in a step-operated cigarette packing machine, to which the following description refers purely by way of example.

BACKGROUND OF THE INVENTION

A cigarette packing machine comprises a number of packing conveyors, each of which has a number of pockets spaced along an endless path and for receiving and conveying respective groups of cigarettes; and the packing conveyors are connected to feed devices for feeding packing materials to the packing conveyor pockets.

Cigarette packing machines are normally "intermittent" machines, i.e. the packing conveyors are operated intermittently (or "in steps), whereby a stop phase, during which the pockets are stationary, is alternated cyclically with a go phase, during which the pockets advance a given distance. In an "intermittent" packing machine, the groups of cigarettes are transferred between two successive packing conveyors at the stop phase.

The output rate of "intermittent" cigarette packing machines has increased continually to a present rate of close to 700 packets a minute, which has been achieved by gradually reducing the duration of the stop phase and increasing the average speed of the go phase. So doing, however, has inevitably increased the acceleration to which the groups of cigarettes are subjected, and has made it necessary to redesign all the component parts of the packing machines to reduce mechanical stress of the groups of cigarettes. This has called for the adoption of sophisticated, highly precise mechanical solutions, which inevitably increase the overall cost of the packing machines, so that modern packing machines are extremely fast, but also extremely expensive to produce and maintain.

To increase the output rate of a cigarette packing machine without increasing the acceleration to which the groups of cigarettes are subjected, a "twin-line" cigarette packing machine has been proposed, i.e. comprising two parallel packing lines. The end result, however, has been no more than a modest increase in output alongside a considerable increase in production cost. In a "twin-line" packing machine, in fact, a problem on one line results in stoppage of the entire machine, i.e. both lines, with obvious repercussions in terms of average output.

To increase the output rate of a cigarette packing machine without increasing the acceleration to which the groups of cigarettes are subjected, a "continuous" cigarette packing machine has also been proposed, whereby the packing conveyor pockets are advanced at constant speed, and the groups of cigarettes are therefore transferred between two successive packing conveyors while the packing conveyors are moving. Though fairly satisfactory in terms of output and the quality of the packets of cigarettes produced, "continuous" cigarette packing machines are mechanically complex and therefore expensive to produce and difficult to set up.

SUMMARY OF THE INVENTION

It is an object of the present invention to provide a method and machine for packing a product in at least one sheet of packing material, which method and machine are designed to eliminate the aforementioned drawbacks and, in particular, are cheap and easy to implement, and provide for a high output rate.

According to the present invention, there are provided a method and machine for packing a product in at least one sheet of packing material, as claimed in the attached Claims.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
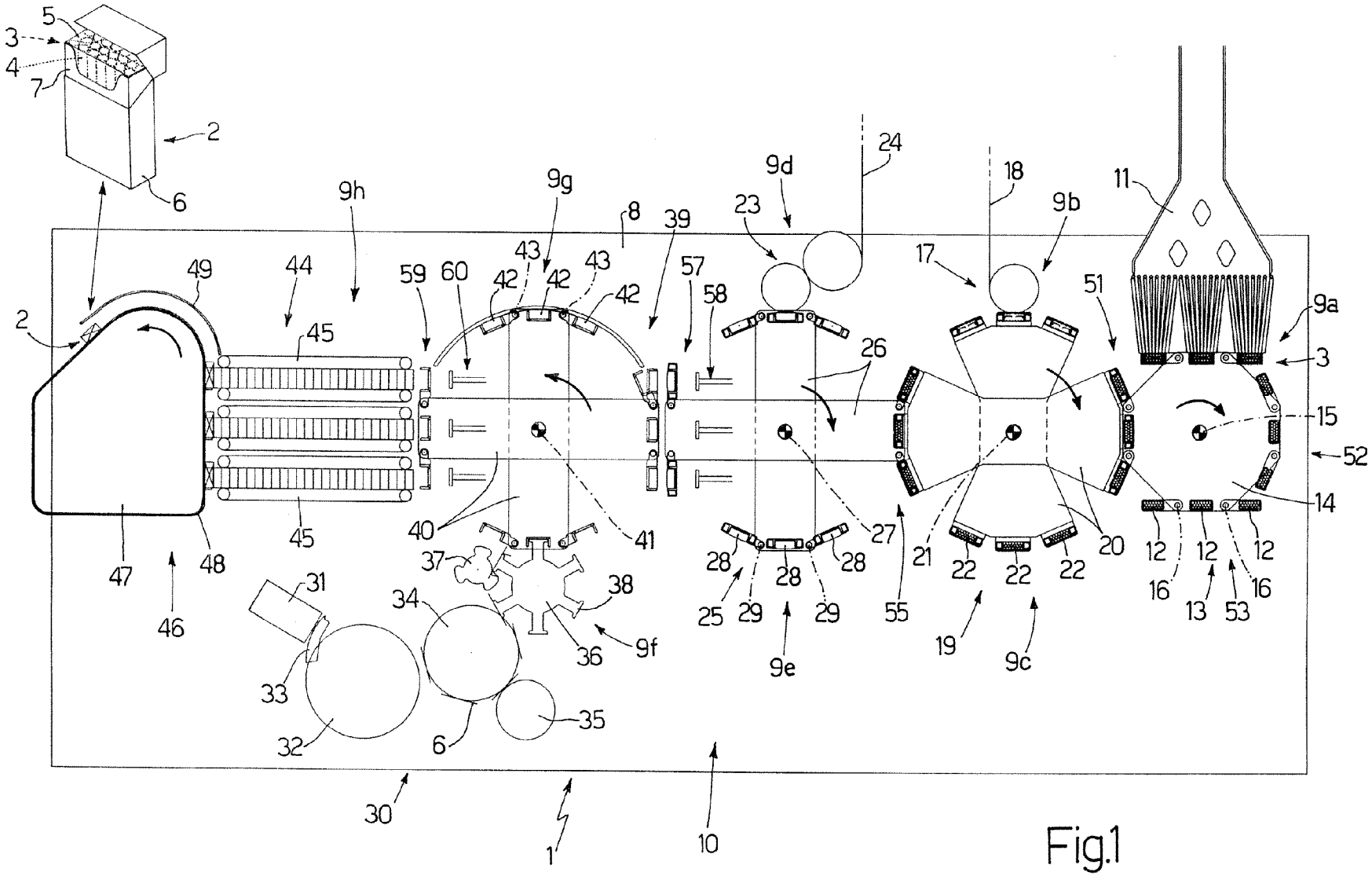
FIG. 1 shows a schematic front view of a cigarette packing machine in accordance with the present invention.

Number 1 in FIG. 1 indicates as a whole a packing machine for producing rigid, hinged-lid packets 2 of cigarettes. Each packet 2 of cigarettes comprises a group 3 of cigarettes, normally comprising twenty cigarettes 4; an inner sheet 5 of foil packing material wrapped about group 3 of cigarettes; and a blank 6 folded about group 3 of cigarettes, wrapped in inner sheet 5 of packing material, to form a rigid, hinged-lid outer container. A U-folded collar 7 is inserted inside the container, at an open top end of the container, to engage an inner surface of the lid when the lid is in a closed position.

Packing machine 1 comprises a frame 8 (shown schematically in FIG. 1) supporting a number of work stations 9 arranged along a production line 10, and each of which comprises a respective number of operating devices. More specifically, packing machine 1 comprises eight work stations 9: a group-forming station 9*a* for forming groups 3 of cigarettes 4; a feed station 9*b* for supplying inner sheets 5 of packing material; a folding station 9*c* for folding inner sheets 5 of packing material about groups 3 of cigarettes 4; a feed station 9*d* for supplying collars 7; a folding station 9*e* for folding collars 7 about groups 3 of cigarettes 4 and on top of the previously folded inner sheets 5 of packing material; a feed station 9*f* for supplying blanks 6; a folding station 9*g* for folding blanks 6 about groups 3 of cigarettes 4 and on top of the previously folded inner sheets 5 of packing material; and a drying station 9*h* for drying packets 2.

Figure 2:
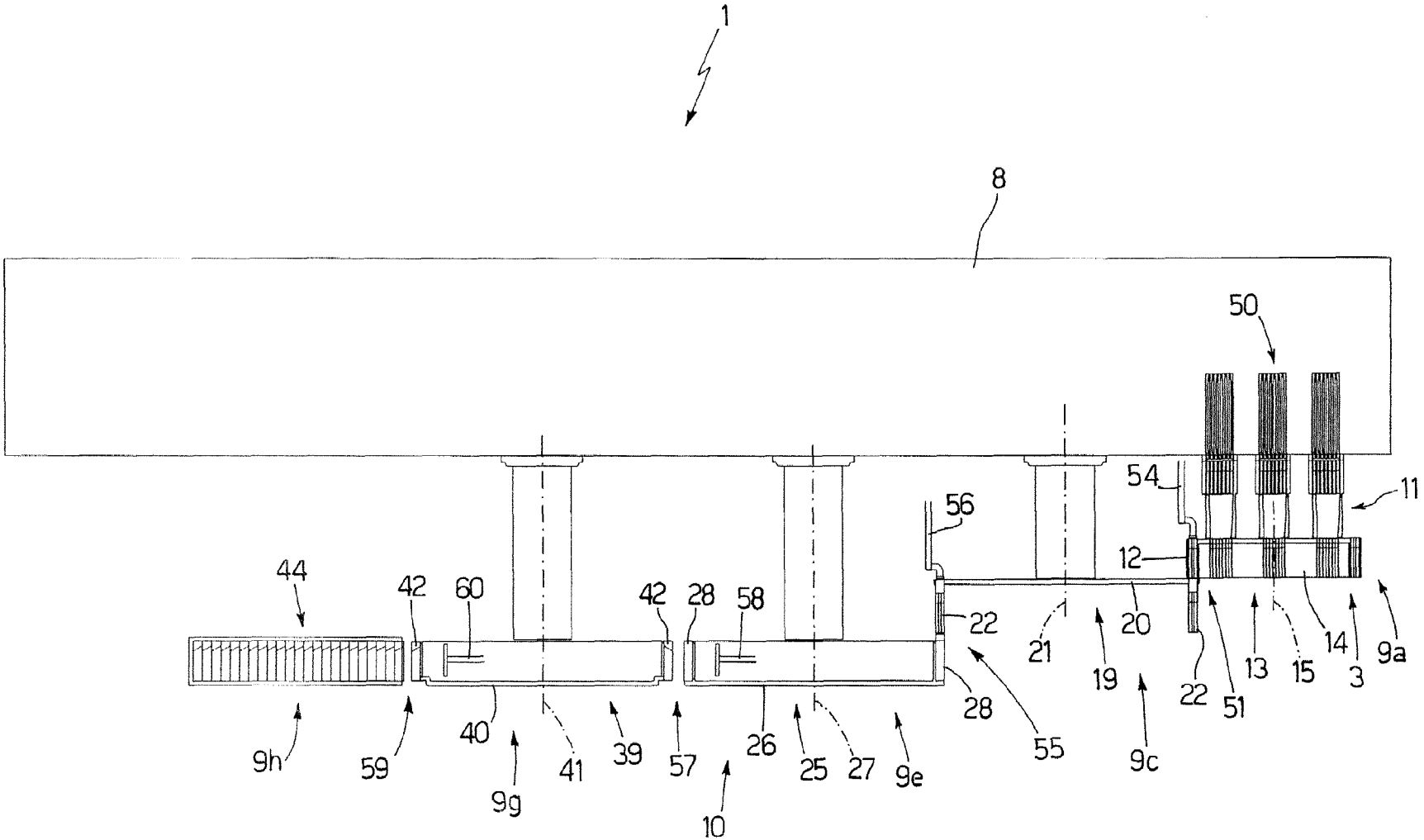
FIG. 2 shows a schematic plan view of the FIG. 1 packing machine.

The following is a description of the main operating devices of each work station 9 as shown in FIGS. 1 and 2. In actual fact, each work station 9 comprises additional operating devices that cannot be detailed in the attached drawings.

Station 9*a* for forming groups 3 of cigarettes 4 comprises a hopper 11 with three outlets for simultaneously feeding three groups 3 of cigarettes 4 to three pockets 12 of a forming conveyor 13. Forming conveyor 13 comprises an octagonal (polygonal) drum 14 which rotates intermittently (or "in steps") about a horizontal axis of rotation 15 perpendicular to the FIG. 1 plane. Drum 14 supports four groups of pockets 12, each comprising three pockets 12; and, in each group of pockets 12, a central pocket 12 is fixed with respect to drum 14, while the other two lateral pockets 12 are hinged to drum 14 and rotated, with respect to drum 14 and about respective axes 16 parallel to axis of rotation 15, by a cam actuating system (not shown). As stated, drum 14 rotates intermittently (or "in steps") about axis of rotation 15, and, at each step, rotates 90° (i.e. by an angle equal to a full turn divided by the number of groups of pockets 12).

Feed station 9*b* comprises a feed device 17, which receives a strip 18 of foil unwound off a reel (not shown), and detaches from foil strip 18 a succession of inner sheets 5 of packing material, which are fed singly (i.e. one at a time) to folding station 9*c*.

Folding station 9*c* comprises a packing conveyor 19 with two arms 20, each of which rotates intermittently (or "in steps") about an axis of rotation 21 parallel to axis of rotation 15. Arms 20 support four groups of three pockets 22 each; and each group of pockets 22 comprises a central pocket 22 and two lateral pockets 22 fixed with respect to relative arm 20. As stated, each arm 20 rotates intermittently (or "in steps") about axis of rotation 21, and, at each step, rotates 90° (i.e. by an angle equal to a full turn divided by the number of groups of pockets 22).

It is important to note that packing conveyor 19 comprises two arms 20, each of which supports two groups of three pockets 22 and rotates intermittently about axis of rotation 21 out of phase with respect to the other arm 20, so that, while the two groups of pockets 22 on one arm 20 are stationary, the two groups of pockets 22 on the other arm 20 may be moving. Obviously, the phase difference between the two movements of the two arms 20 must be such as to avoid any type of mechanical interference between the two arms 20.

Feed station 9*d* comprises a feed device 23, which detaches collars 7 successively from a strip 24 of collars 7 unwound off a reel (not shown), and feeds collars 7 singly (i.e. one at a time) to folding station 9*e*.

Folding station 9*e* comprises a packing conveyor 25 with two arms 26, each of which rotates intermittently (or "in steps") about an axis of rotation 27 parallel to axis of rotation 15. Arms 26 support four groups of pockets 28, each comprising three pockets 28; and, in each group of pockets 28, a central pocket 28 is fixed with respect to arm 26, while the other two lateral pockets 28 are hinged to arm 26 and rotated, with respect to arm 26 and about respective axes 29 parallel to axis of rotation 27, by a cam actuating system (not shown). As stated, each arm 26 rotates intermittently (or "in steps") about axis of rotation 27, and, at each step, rotates 90° (i.e. by an angle equal to a full turn divided by the number of groups of pockets 28). It is important to note that packing conveyor 25 comprises two arms 26, each of which supports two groups of three pockets 28 and rotates intermittently about axis of rotation 27 out of phase with respect to the other arm 26, so that, while the two groups of pockets 28 on one arm 26 are stationary, the two groups of pockets 28 on the other arm 26 may be moving. Obviously, the phase difference between the two movements of the two arms 26 must be such as to avoid any type of mechanical interference between the two arms 26.

Feed station 9*f* comprises a feed device 30, which withdraws blanks 6 successively from the bottom of a hopper 31 and feeds blanks 6 singly (i.e. one at a time) to folding station 9*g*. Feed device 30 comprises a pickup drum 32 with a number of suction seats 33 (only one shown in FIG. 1) for withdrawing blanks 6 from the bottom of hopper 31 and feeding them to an intermediate suction drum 34. Intermediate drum 34 feeds blanks 6 through a gumming station, where glue is deposited by a gumming drum 35 onto the inner face of each blank 6, and then releases the gummed blanks 6 onto a feed drum 36. Feed drum 36 feeds blanks 6 through a prefolding station, where each blank 6 is folded by a prefolding member 37 along a number of preformed longitudinal fold lines, and then feeds the gummed, prefolded blanks 6 successively and singly (i.e. one at a time) to folding station 9*g*.

Feed drum 36 has a number of suction seats 38, each of which engages a central portion of a blank 6 and is the same shape and size as a group 3 of cigarettes. Prefolding member 37 is a drum with three lobes, which, as they rotate, fold the lateral portions of each blank 6 onto respective suction seat 38.

Folding station 9*g* comprises a packing conveyor 39 with two arms 40, each of which rotates intermittently (or "in steps") about an axis of rotation 41 parallel to axis of rotation 15. Arms 40 support four groups of pockets 42, each comprising three pockets 42; and, in each group of pockets 42, a central pocket 42 is fixed with respect to arm 40, while the other two lateral pockets 42 are hinged to arm 40 and rotated, with respect to arm 40 and about respective axes 43 parallel to axis of rotation 41, by a cam actuating system (not shown). As stated, each arm 40 rotates intermittently (or "in steps") about axis of rotation 41, and, at each step, rotates 90° (i.e. by an angle equal to a full turn divided by the number of groups of pockets 42). It is important to note that packing conveyor 39 comprises two arms 40, each of which supports two groups of three pockets 42 and rotates intermittently about axis of rotation 41 out of phase with respect to the other arm 40, so that, while the two groups of pockets 42 on one arm 40 are stationary, the two groups of pockets 42 on the other arm 40 may be moving. Obviously, the phase difference between the two movements of the two arms 40 must be such as to avoid any type of mechanical interference between the two arms 40.

Drying station 9*h* comprises a linear drying conveyor 44, in turn comprising three parallel conveyor belts 45 defining three parallel horizontal paths for packets 2 of cigarettes.

An output conveyor 46, located downstream from linear drying conveyor 44, receives packets 2 of cigarettes from the three conveyor belts 45, and feeds packets 2 of cigarettes along a single output path. The output path comprises a straight vertical initial portion at the outlets of the three conveyor belts 45; a curved intermediate portion; and a straight, downward-sloping end portion. Output conveyor 46 comprises a box body 47, along which runs an endless conveyor belt 48 having a number of projections (not shown) for pushing along packets 2 of cigarettes, which are maintained contacting conveyor belt 48 by a number of fixed rails 49 (only one shown in FIG. 1).

Operation of packing machine 1 will now be described with reference to the packing operations performed successively on a set of three groups 3 of cigarettes.

At group-forming station 9*a*, drum 14 of forming conveyor 13 advances one step (rotates 90° clockwise) to position a group of three pockets 12 in front of the three outlets of hopper 11; when the group of three pockets 12 is stopped in front of the three outlets of hopper 11, the three pockets 12 are aligned with one another, and each pocket 12 is positioned axially facing and aligned with a respective outlet of hopper 11. At this point, a pusher 50 (shown in FIG. 2) with three parallel push members transfers the three groups 3 of cigarettes from the outlets of hopper 11 to the three pockets 12. Pusher 50 performs a reciprocating movement comprising a forward stroke and a return stroke, both parallel to axis of rotation 15, as the three pockets 12 are stationary in front of the three outlets of hopper 11.

Three more steps of drum 14 of forming conveyor 13 (each defined by a 90° clockwise rotation) bring the three pockets 12 containing the three groups 3 of cigarettes up to a transfer station 51 defined between forming conveyor 13 and packing conveyor 19. Between hopper 11 and transfer station 51, provision is preferably made for a control station 52 (shown schematically), for checking groups 3 of cigarettes are complete and the tips of cigarettes 4 are filled properly, and a downstream reject station 53 (shown schematically) for rejecting any incomplete groups 3 of cigarettes, or any groups containing cigarettes 4 with poorly filled tips. Control station 52 comprises three control devices (not shown) for simultaneously controlling the three groups 3 of cigarettes in the three pockets 12 during a stop phase, i.e. when each pocket 12 is stationary in front of a respective control device. And similarly, reject station 53 comprises three reject devices (not shown) for rejecting any one of the three groups 3 of cigarettes in the three pockets 12 during a stop phase, i.e. when each pocket 12 is stationary in front of a respective reject device.

Rotating clockwise, one arm 20 of packing conveyor 19 feeds a group of three pockets 22 into transfer station 51. When the group of three pockets 12 is stopped at transfer station 51, the three pockets 12 are arranged in a "U" to match the arrangement of the three pockets 22, so that each pocket 12 is positioned axially facing and aligned with a respective pocket 22. At this point, a pusher 54 (shown in FIG. 2) with three parallel push members (only one shown in FIG. 2) transfers the three groups 3 of cigarettes from pockets 12 to pockets 22. Pusher 54 performs a reciprocating movement comprising a forward stroke and a return stroke, both parallel to axes of rotation 15 and 21, as the three pockets 22 are stationary in front of the three pockets 12.

Before being fed into transfer station 51, the group of three pockets 22 on packing conveyor 19 is fed through feed station 9*b*, where each pocket 22 receives an inner sheet 5 of packing material, which is folded into a tube about pocket 22. Each pocket 22 is preferably in the form of a hollow spindle, on the outside of which an inner sheet 5 of packing material is folded into a tube, and inside which a group 3 of cigarettes is inserted. Feed device 17 is designed to supply one inner sheet 5 of packing material at a time, and therefore feeds three sheets 5 of foil packing material successively to the three pockets 22 in a group of pockets 22. Feed device 17 feeds each inner sheet 5 of packing material to pocket 22 while pocket 22 is moving and as it travels past feed device 17. The movement of each arm 20 is preferably such that each group of three pockets 22 is never stopped in front of, but travels at reduced, constant speed past, feed device 17. In other words, each group of three pockets 22, as opposed to being stopped in front of feed device 17, preferably travels at reduced, constant speed past feed device 17, in that feed device 17 is designed to feed each inner sheet 5 of packing material to pocket 22 while pocket 22 is moving.

Once the three groups 3 of cigarettes are fed into the three pockets 22 at transfer station 51, arm 20 of packing conveyor 19 rotates 180° clockwise to feed the three pockets 22 containing the three groups 3 of cigarettes to a transfer station 55 defined between packing conveyor 19 and packing conveyor 25. Between transfer station 51 and transfer station 55, each inner sheet 5 of packing material is folded in known manner about pocket 22.

At the same time, rotating clockwise, one arm 26 of packing conveyor 25 feeds a group of three pockets 28 into transfer station 55. When the group of three pockets 28 is stopped at transfer station 55, the three pockets 28 are arranged in a "U" to match the arrangement of the three pockets 22, so that each pocket 28 is positioned axially facing and aligned with a respective pocket 22. At this point, a pusher 56 (shown in FIG. 2) with three parallel push members (only one shown in FIG. 2) transfers the three groups 3 of cigarettes from pockets 22 to pockets 28. Pusher 56 performs a reciprocating movement comprising a forward stroke and a return stroke, both parallel to axes of rotation 21 and 27, as the three pockets 28 are stationary in front of the three pockets 22.

Before being fed into transfer station 55, the group of three pockets 28 on packing conveyor 25 is fed through feed station 9*d*, where each pocket 28 receives a collar 7, which is folded into a "U" inside pocket 28. Feed device 23 is designed to supply one collar 7 at a time, and therefore feeds three collars 7 successively to the three pockets 28 in a group of pockets 28. Feed device 23 feeds each collar 7 to pocket 28 while pocket 28 is moving and as it travels past feed device 23. The movement of each arm 26 of packing conveyor 25 is preferably such that each group of three pockets 28 is never stopped in front of, but travels at reduced, constant speed past, feed device 23. In other words, each group of three pockets 28, as opposed to being stopped in front of feed device 23, preferably travels at reduced, constant speed past feed device 23, in that feed device 23 is designed to feed each collar 7 to pocket 28 while pocket 28 is moving.

Once the three groups 3 of cigarettes are fed into the three pockets 28 at transfer station 55, arm 26 of packing conveyor 25 rotates 180° clockwise to feed the three pockets 28 containing the three groups 3 of cigarettes to a transfer station 57 defined between packing conveyor 25 and packing conveyor 39. When the group of three pockets 28 is stopped at transfer station 57, the three pockets 28 are aligned vertically with one another.

At the same time, rotating anticlockwise, one arm 40 of packing conveyor 39 feeds a group of three pockets 42 into transfer station 57. When the group of three pockets 42 is stopped at transfer station 57, the three pockets 42 are aligned vertically with one another to match the arrangement of the three pockets 28, so that each pocket 42 is positioned radially facing and aligned with a respective pocket 28. At this point, a pusher 58 with three parallel push members transfers the three groups 3 of cigarettes from pockets 28 to pockets 42. Pusher 58 performs a reciprocating movement comprising a forward stroke and a return stroke, both perpendicular to axes of rotation 27 and 41, as the three pockets 42 are stationary in front of the three pockets 28.

Before being fed into transfer station 57, the group of three pockets 42 on packing conveyor 39 is fed through feed station 9*f*, where each pocket 42 receives a blank 6, which is folded into a "U" inside pocket 42. Feed device 30 is designed to supply one blank 6 at a time, and therefore feeds three blanks 6 successively to the three pockets 42 in a group of pockets 42. Feed device 30 feeds each blank 6 to pocket 42 while pocket 42 is moving and as it travels past feed device 30. The movement of each arm 40 of packing conveyor 39 is preferably such that each group of three pockets 42 is never stopped in front of, but travels at reduced, constant speed past, feed device 30. In other words, each group of three pockets 42, as opposed to being stopped in front of feed device 30, preferably travels at reduced, constant speed past feed device 30, in that feed device 30 is designed to feed each blank 6 to pocket 42 while pocket 42 is moving.

Once the three groups 3 of cigarettes are fed into the three pockets 42 at transfer station 57, arm 40 of packing conveyor 39 rotates 180° anticlockwise to feed the three pockets 42 containing the three groups 3 of cigarettes to a transfer station 59 defined between packing conveyor 39 and drying conveyor 44. Between transfer station 57 and transfer station 59, each blank 6 is folded in known manner about group 3 of cigarettes.

When the group of three pockets 42 is stopped at transfer station 59, the three pockets 42 are aligned vertically with one another, so that each pocket 42 is positioned radially aligned with and facing an inlet of a respective conveyor belt 45 of drying conveyor 44. At this point, a pusher 60 with three parallel push members transfers the three packets 2 of cigarettes containing the three groups 3 of cigarettes from pockets 42 to conveyor belts 45 of drying conveyor 44. Pusher 60 performs a reciprocating movement comprising a forward stroke and a return stroke, both perpendicular to axis of rotation 41, as the three pockets 42 are stationary in front of the three conveyor belts 45 of drying conveyor 44.

The three conveyor belts 45 of drying conveyor 44 feed the three packets 2 of cigarettes containing the three groups 3 of cigarettes to output conveyor 46, which receives the three packets 2 of cigarettes containing the three groups 3 of cigarettes from the three conveyor belts 45, and feed packets 2 along the single output path. It is important to note that the output path of output conveyor 46 is initially vertical and therefore perpendicular to the three horizontal paths of the three conveyor belts 45, so that, when transferred from the three conveyor belts 45 to output conveyor 46, all the packets 2 of cigarettes are collected along a common output path.

Figure 3:
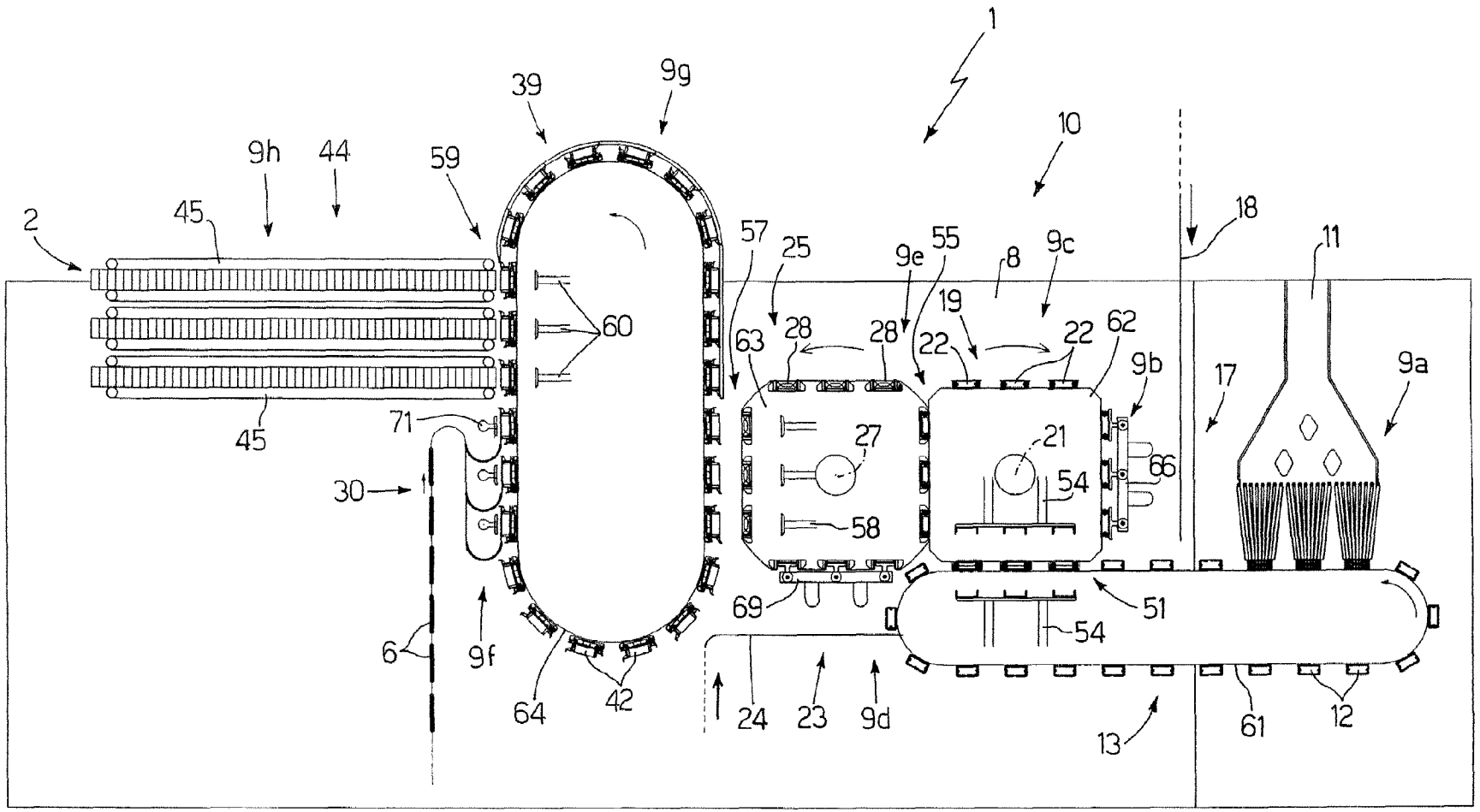
FIG. 3 shows a schematic front view of an alternative embodiment of a cigarette packing machine in accordance with the present invention.
Figure 4:
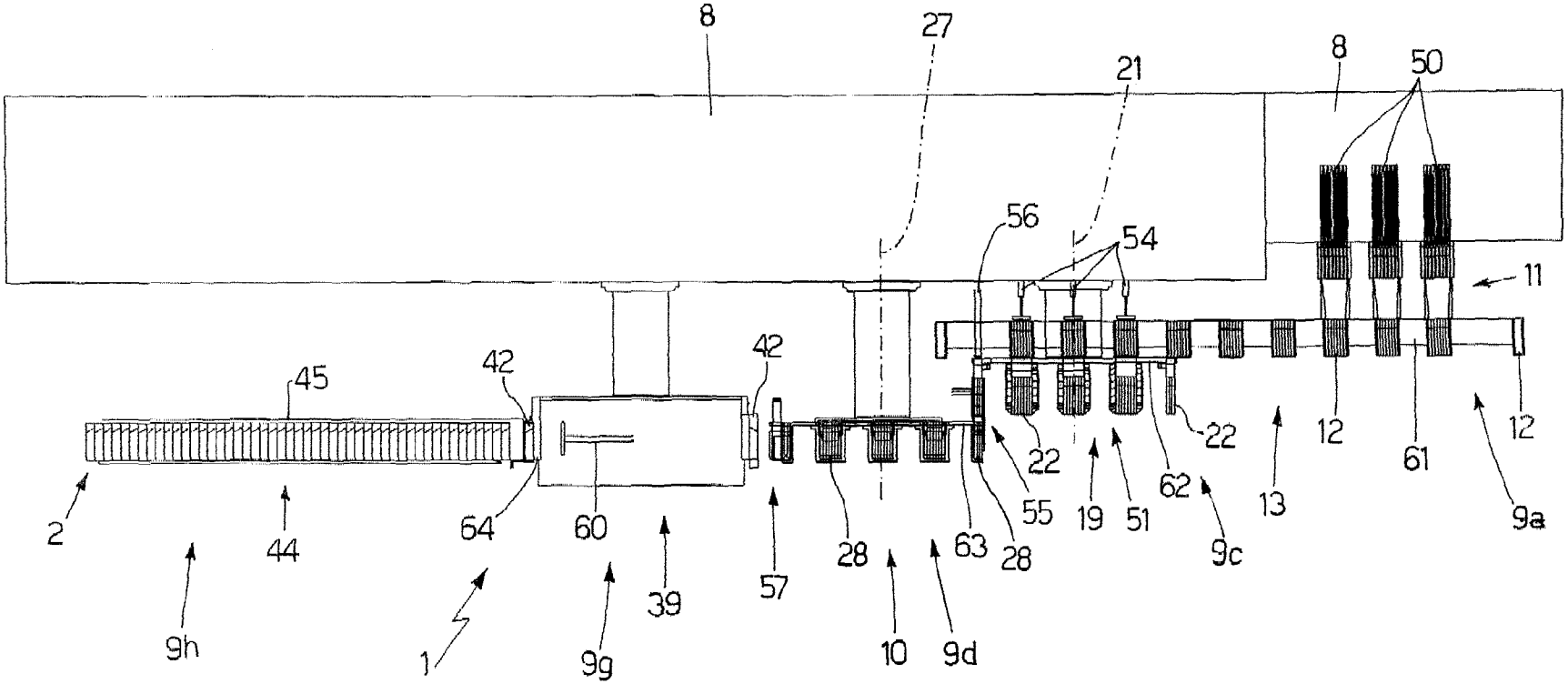
FIG. 4 shows a schematic plan view of the FIG. 3 packing machine.

FIGS. 3 and 4 show a variation of packing machine 1 in FIGS. 1 and 2. The main difference between packing machine 1 in FIGS. 1 and 2 and packing machine 1 in FIGS. 3 and 4 lies in the design of conveyors 13, 19, 25, 39.

Whereas forming conveyor 13 of packing machine 1 in FIGS. 1 and 2 comprises a drum 14 rotating in steps about central axis of rotation 15, forming conveyor 13 of packing machine 1 in FIGS. 3 and 4 comprises a belt 61 looped about two powered end pulleys (not shown) and moving in steps along an endless, elongated O-shaped, substantially horizontal path. Belt 61 of forming conveyor 13 is fitted with eight groups of pockets 12, each comprising three pockets 12 in fixed positions along belt 61.

Packing conveyor 19 of packing machine 1 in FIGS. 1 and 2 comprises two arms 20, each rotating in steps about central axis of rotation 21 and supporting two groups of pockets 22, each comprising a central pocket 22 and two lateral pockets 22 fixed with respect to relative arm 20; whereas packing conveyor 19 of packing machine 1 in FIGS. 3 and 4 comprises a drum 62 rotating in steps about central axis of rotation 21 and supporting four groups of pockets 22, each comprising three pockets 22, one central and two lateral, fixed with respect to drum 62. Drum 62 is polygonal with four flat faces (i.e. is square), each of which supports all the pockets 22 of a respective group of pockets 22 aligned with one another in a line parallel to the flat face.

Packing conveyor 25 of packing machine 1 in FIGS. 1 and 2 comprises two arms 26, each rotating in steps about central axis of rotation 27 and supporting two groups of pockets 28; whereas packing conveyor 25 of packing machine 1 in FIGS. 3 and 4 comprises a drum 63 rotating in steps about central axis of rotation 27 and supporting four groups of pockets 28, each comprising three pockets 28. Drum 63 is polygonal with four flat faces (i.e. is square), each of which supports all the pockets 28 of a respective group of pockets 28 aligned with one another in a line parallel to the flat face. In the FIGS. 1 and 2 embodiment, a central pocket 28 in each group of pockets 28 is fixed with respect to arm 26, and the other two lateral pockets 28 are hinged to arm 26; whereas, in the FIGS. 3 and 4 embodiment, all the pockets 28 in each group of pockets 28 are fitted in fixed positions to drum 63.

Packing conveyor 39 of packing machine 1 in FIGS. 1 and 2 comprises two arms 40, each rotating in steps about central axis of rotation 41 and supporting two groups of pockets 42; whereas packing conveyor 39 of packing machine 1 in FIGS. 3 and 4 comprises a belt 64 looped about two powered end pulleys (not shown) and moving in steps along an endless, elongated O-shaped, substantially horizontal path. Each arm 40 of packing conveyor 39 of packing machine 1 in FIGS. 1 and 2 supports two groups of pockets 42; and, in each group of pockets 42, a central pocket 42 is fixed with respect to arm 40, while the other two lateral pockets 42 are hinged to arm 40 and rotated, with respect to arm 40 and about respective axes parallel to axis of rotation 41, by a cam actuating system (not shown). Belt 64 of packing conveyor 39 of packing machine 1 in FIGS. 3 and 4 supports eight groups of pockets 12, each comprising three pockets 12 in fixed positions along belt 64.

It is important to note that both drum 62 of packing conveyor 19 and drum 63 of packing conveyor 25 are polygonal in section—in particular, square, to support four groups of pockets 22 and 28 respectively—with four faces, each of which is perpendicular to the two adjacent faces and supports a group of pockets 22 or 28.

Packing machine 1 in FIGS. 1 and 2 and packing machine 1 in FIGS. 3 and 4 also differ in the design of feed devices 17, 23, 30.

In the FIGS. 1 and 2 embodiment, feed device 17, 23, 30 feeds one inner sheet 5 of packing material, collar 7, blank 6 to one pocket 22, 28, 42 as pocket 22, 28, 42 is moving and as it travels past feed device 17, 23, 30. In other words, feed device 17, 23, 30 supplies one inner sheet 5 of packing material, collar 7, blank 6 at a time, and therefore supplies three sheets 5 of foil packing material, collars 7, blanks 6 successively to the three pockets 22, 28, 42 in a group of pockets 22, 28, 42. In the FIGS. 3 and 4 embodiment, feed device 17, 23, 30 supplies three sheets 5 of foil packing material, collars 7, blanks 6 simultaneously to the three pockets 22, 28, 42 in a group of pockets 22, 28, 42, when the three pockets 22, 28, 42 are stationary in front of feed device 17, 23, 30.

Figure 5:
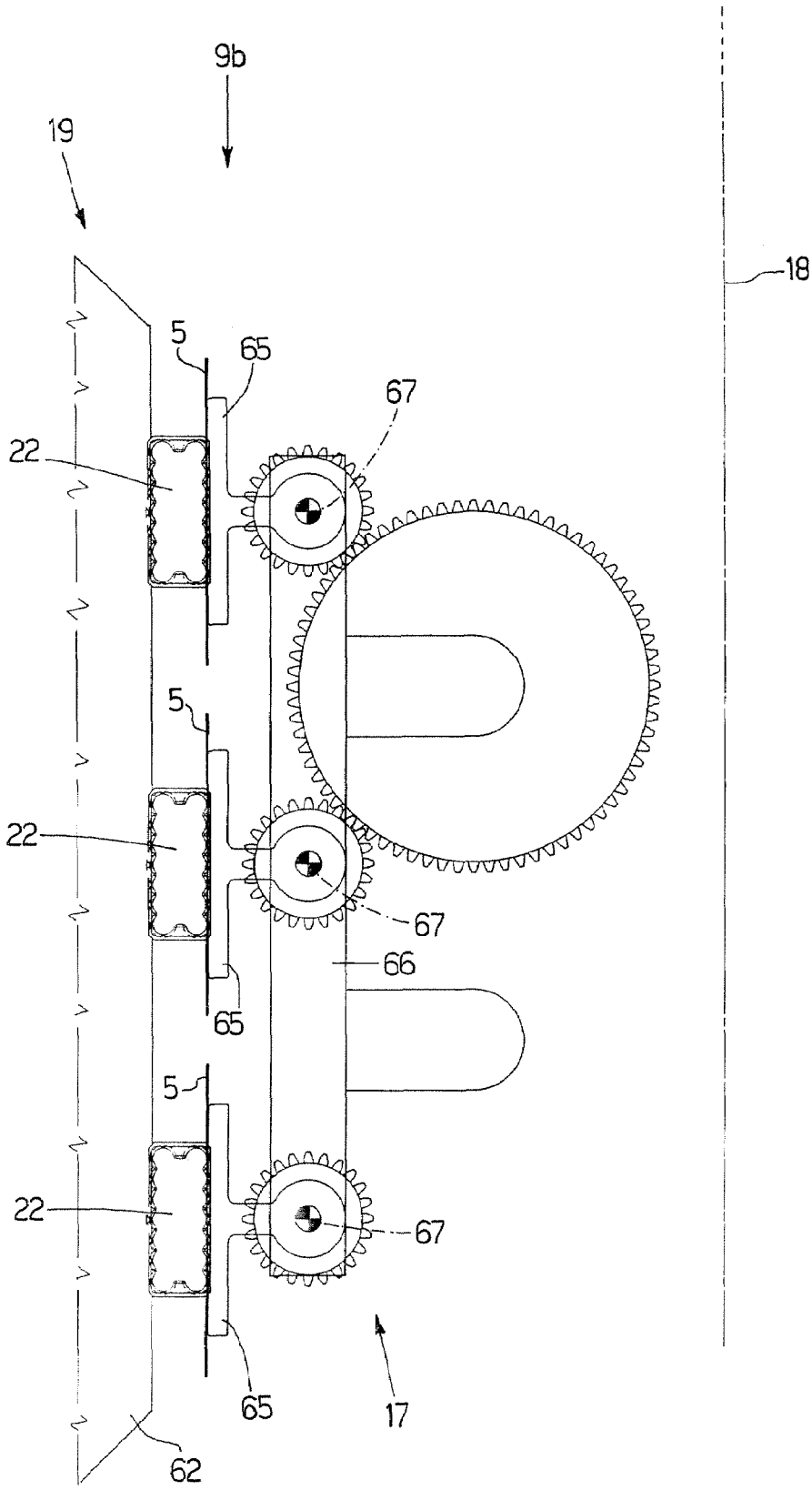
FIG. 5 shows a feed device of the FIG. 3 packing machine, for supplying inner sheets of foil packing material.

As shown in FIG. 5, feed device 17 comprises three suction heads 65 fitted to a movable member 66, which moves back and forth between a receiving position at foil strip 18 unwound off a reel (not shown), and a release position at packing conveyor 19. Each suction head 65 is hinged to movable member 66 to rotate, with respect to movable member 66, about a horizontal axis of rotation 67 parallel to axis of rotation 21 of drum 62 of packing conveyor 19. More specifically, each suction head 65 is rotated about axis of rotation 67 by a gear mechanism driven by the movement of movable member 66.

In actual use, to begin with, movable member 66 is stationary in the receiving position at foil strip 18, and the three suction heads 65 are positioned with their respective suction surfaces contacting foil strip 18. At this point, a cutting device (not shown) cuts foil strip 18 at three separate points to detach from foil strip 18 three sheets 5 of foil packing material, each of which remains attached to a respective suction head 65. Next, movable member 66 moves from the receiving position at foil strip 18 to the release position at packing conveyor 19; in the course of which movement of movable member 66, each suction head 65 rotates, with respect to movable member 66, 180° about axis of rotation 67, so that the suction surface supporting inner sheet 5 of packing material is positioned facing packing conveyor 19. By the time movable member 66 reaches the release position, each suction head 65 is positioned substantially contacting a respective pocket 22; at which point, suction through each suction head 65 is cut off to transfer inner sheet 5 of packing material from suction head 65 to pocket 22. Movable member 66 then moves back from the release position at packing conveyor 19 to the receiving position at foil strip 18, and suction through suction heads 65 is restored. In the meantime, foil strip 18 is unwound further off the reel to replace the cut-off portion of strip 18.

Figure 6:
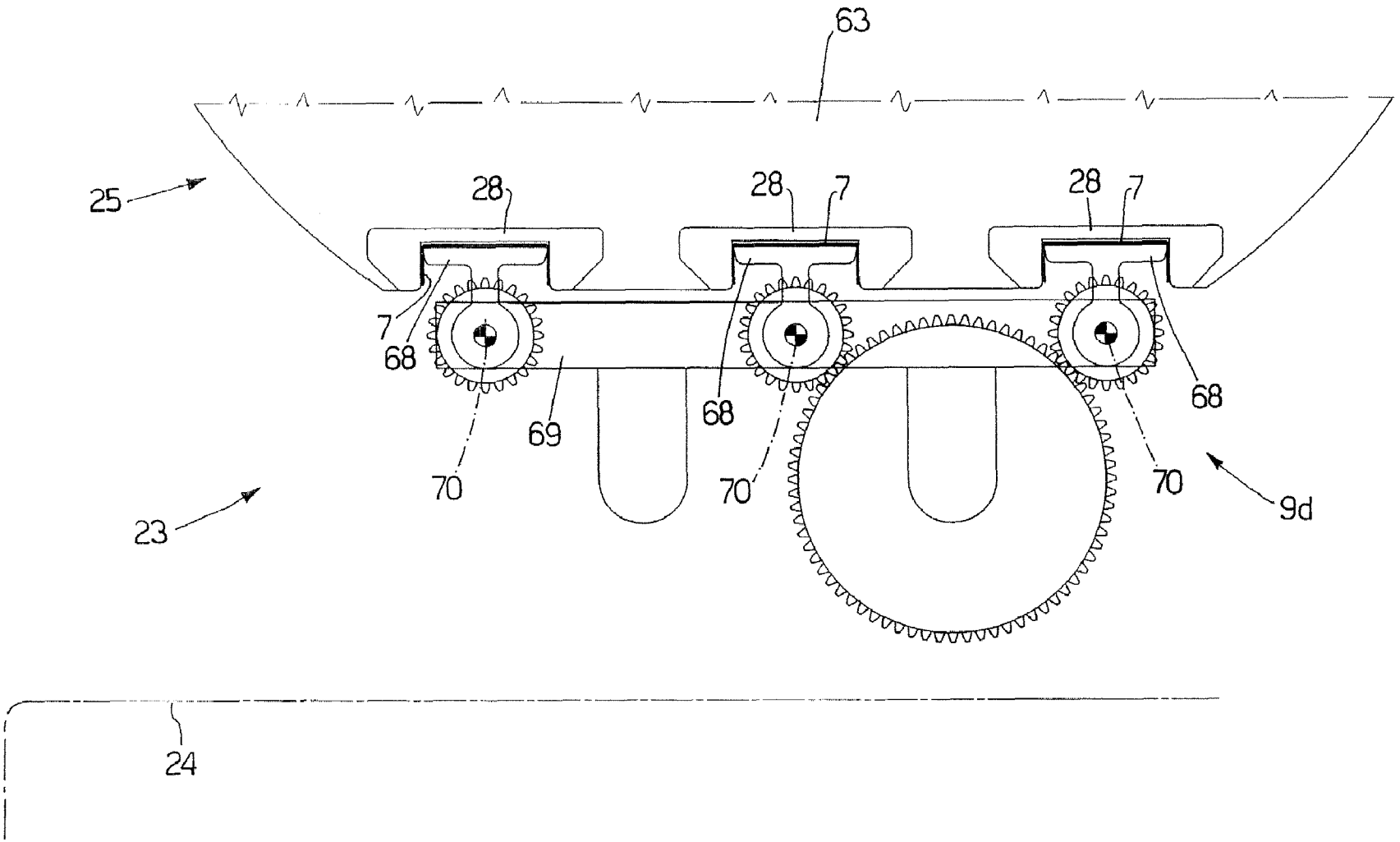
FIG. 6 shows a collar feed device of the FIG. 3 packing machine.

As shown in FIG. 6, feed device 23 is identical to feed device 17, and comprises three suction heads 68 fitted to a movable member 69, which moves back and forth between a receiving position at collar strip 24 unwound off a reel (not shown), and a release position at packing conveyor 25. Each suction head 68 is hinged to movable member 69 to rotate, with respect to movable member 69, about a horizontal rotation axis 70 parallel to axis of rotation 27 of drum 63 of packing conveyor 25. More specifically, each suction head 68 is rotated about rotation axis 70 by a gear mechanism driven by the movement of movable member 69. Feed device 23 operates in exactly the same way as feed device 17 described above.

Figure 7:
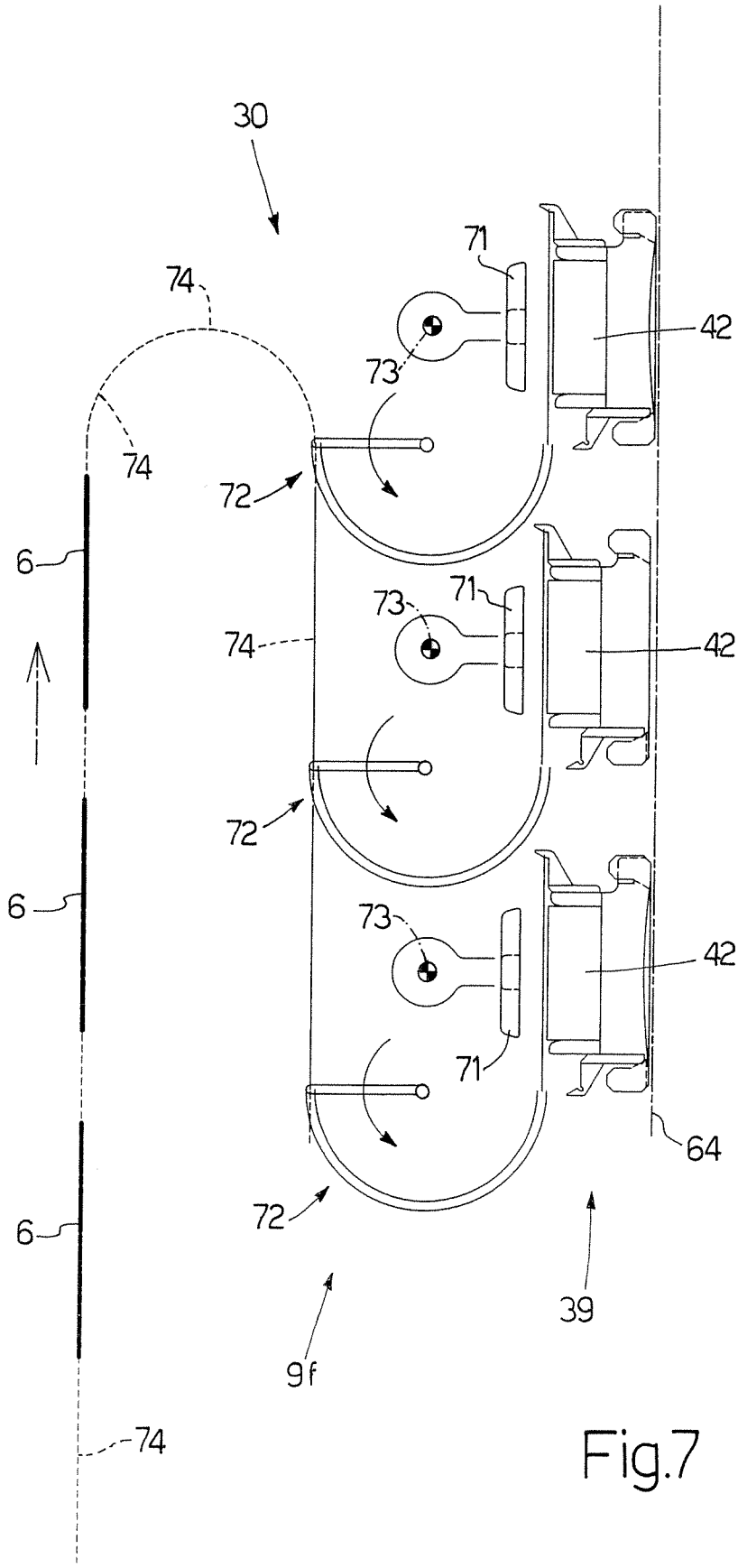
FIG. 7 shows a blank feed device of the FIG. 3 packing machine.

As shown in FIG. 7, feed device 30 comprises three insertion heads 71 which move back and forth to simultaneously insert three blanks 6—in a feed position in front of insertion heads 71—into three pockets 42 in a group of pockets 42 on packing conveyor 39. Feed device 30 also comprises three conveying devices 72, each of which rotates in steps about a horizontal axis of rotation parallel to axis of rotation 73 to withdraw a blank 6 from a blank 6 feed line 74, and to feed blank 6 into a feed position in front of a respective insertion head 71. More specifically, each conveying device 72 rotates in steps in the same direction at all times (anticlockwise in the FIG. 7 embodiment), and rotates 360° at each step.

As will be clear from the foregoing description, each of a number of conveyors 13, 19, 25, 39 comprises a number of pockets 12, 22, 28, 42 arranged along an endless path to receive and convey respective groups 3 of cigarettes; and the groups 3 of cigarettes are transferred from each conveyor 13, 19, 25 to the next conveyor 19, 25, 39 at a transfer station 51, 55, 57 defined between the two conveyors 13, 19, 25, 39. The pockets 12, 22, 28, 42 of each conveyor 13, 19, 25, 39 are divided into a number N1 of (four) groups, each comprising an equal number N2 of (three) pockets 12, 22, 28, 42; and, at each transfer station 51, 55, 57, a number N2 of (three) products are transferred simultaneously from the pockets 12, 22, 28 in a group of pockets 12, 22, 28 on the releasing conveyor 13, 19, 25 to the pockets 22, 28, 42 in a group of pockets 22, 28, 42 on the receiving conveyor 19, 25, 39.

In the embodiment shown, each group of pockets 12, 22, 28, 42 comprises three pockets 12, 22, 28, 42, so that three groups 3 of cigarettes are transferred simultaneously at each transfer station 51, 55, 57. In alternative embodiments not shown, each group of pockets 12, 22, 28, 42 may comprise a different number of pockets 12, 22, 28, 42 greater than one (e.g. two or four).

In the FIGS. 1 and 2 embodiment, all the conveyors 13, 19, 25, 39 are rotary, i.e. each comprise a drum 14, 20, 26, 40 supporting pockets 12, 22, 28, 42 and rotating about a respective central axis 15, 21, 27, 41 to feed the pockets 12, 22, 28, 42 along a circular path. In the FIGS. 3 and 4 embodiment, forming conveyor 13 and packing conveyor 39 are belt conveyors.

In the FIGS. 1 and 2 embodiment, all the conveyors 13, 19, 25, 39 comprise the same number N1 of (four) groups of pockets 12, 22, 28, 42. In the FIGS. 3 and 4 embodiment, forming conveyor 13 and packing conveyor 39 comprise a number N1 of eight groups of pockets 12, 42, whereas packing conveyor 19 and packing conveyor 25 comprise a number N1 of four groups of pockets 22, 28.

As will be clear from the foregoing description, in the FIGS. 1 and 2 embodiment, pockets 28, 42 of packing conveyor 25, 39 are divided into four groups of pockets 28, 42; in each group of pockets 28, 42, the central pocket 28, 42 is connected in a fixed position (i.e. rigidly) to packing conveyor 25, 39, and the two lateral pockets 28, 42 are hinged to packing conveyor 25, 39 to rotate between an extracted position at transfer stations 55, 57, 59, and a withdrawn position at feed station 9*d*, 9*f*. In the extracted position, pockets 28, 42 of packing conveyor 25, 39 are at least partly extracted with respect to packing conveyor 25, 39 and aligned with one another in a straight line; and, in the withdrawn position, pockets 28, 42 of packing conveyor 25, 39 are positioned tangentially with respect to packing conveyor 25, 39 and therefore aligned along an arc of a circle.

Finally, as will be clear from the foregoing description of the FIGS. 1 and 2 embodiment, packing conveyors 19, 25, 39 have respective pockets 22, 28, 42, each of which receives a group 3 of cigarettes at a first transfer station 51, 55, 57, releases the product at a second transfer station 55, 57, 59, and receives an inner sheet 5 of packing material, collar 7, blank 6 at a feed station 9*b*, 9*d*, 9*f* comprising a feed device 17, 23, 30. Each group 3 of cigarettes is transferred to a pocket 22, 28, 42 and from the pocket 22, 28, 42 while the pocket 22, 28, 42 is stationary at the first transfer station 51, 55, 57 and second transfer station 55, 57, 59 respectively; whereas the inner sheet 5 of packing material, collar 7, blank 6 is transferred to a pocket 22, 28, 42 as the pocket 22, 28, 42 travels through the feed station 9*b*, 9*d*, 9*f* and is moving with respect to the feed device 17, 23, 30. In other words, the movement of packing conveyors 19, 25, 39 is such that each pocket 22, 28, 42 is arrested at the transfer stations 51, 55, 57, 59, but not at the feed station 9*b*, 9*d*, 9*f*, and so travels through the feed station 9*b*, 9*d*, 9*f* at substantially constant speed.

Packing machine 1 as described above has numerous advantages. In particular, performing the packing operations simultaneously on three pockets provides for achieving a high output rate, while at the same time allowing a fairly long time interval in which to perform each packing operation, which can thus be performed highly accurately without recourse to complicated, untried technical solutions. Moreover, given the step operation of the packing wheels, packing machine 1 as described above is also cheap and easy to implement and set up.

Given the numerous advantages afforded, the above product packing method may also be applied to other automatic cigarette packing machines (e.g. cellophaning and cartoning machines) or to automatic machines for packing other types of products (e.g. confectionary, beverages, medicines).

Patent U.S. Pat. No. 6,516,811 B1 describes a method of controlling a tobacco processing system comprising a cigarette manufacturing machine, a filter assembly machine, a packing machine, a cellophaning machine, a cartoning machine, and a boxing machine. For each machine in the system, the exact amount of packing material to be supplied to the machine is determined before commencing production, as a function of the number of products (e.g. packets of cigarettes, cartons of cigarettes, boxes of cartons of cigarettes) to be produced, and taking into account the usual reject percentage. A higher than expected reject percentage during processing results in a corresponding increase in the amount of packing material to be supplied to the machine, which increase is indicated to the operator in charge of procuring and supplying the packing material.

In short, the method in Patent U.S. Pat. No. 6,516,811 B1 provides for first determining the exact amount of packing material to be supplied to each machine, and for only altering the estimate in the event of a higher than expected reject percentage. The method described is complicated to actually implement, on account of the difficulty and uncertainty involved in estimating the reject percentage of the machine.

Moreover, the operator is only instructed to increase material supply to the machine when the system detects a higher than normal reject percentage, as opposed to being constantly informed of the outstanding material required by the machine, thus making the operator's job difficult to schedule.

The method described in Patent U.S. Pat. No. 6,516,811 B1 may be applied satisfactorily to very small production lots requiring small amounts of packing material that can be stocked beforehand close to or on the machine, but is unsuitable for large production lots requiring large amounts of packing material that cannot be stocked beforehand close to or on the machine.

To eliminate the above drawbacks, a tobacco processing system comprising at least one packing machine 1 as described above (and preferably a number of machines connected in series) is controlled as described below to simplify the job of the operator in charge of procuring and supplying packing material 5, 6 and 7 (i.e. sheets 5 of packing material, blanks 6 and collars 7).

Before the system, and hence packing machine 1, is started up, packing machine 1 is assigned a given output number of packets 2 of cigarettes; and the operator then loads a given amount of packing material 5, 6, 7 at feed stations 9*b*, 9*d*, 9*f* of packing machine 1. At this point, packing machine 1 is started up to commence production of packets 2 of cigarettes, and, as packing machine 1 is running, the number of acceptable packets 2 of cigarettes produced is determined cyclically, the outstanding number of packets 2 of cigarettes to be produced is determined cyclically as a function of the set number of packets 2 of cigarettes to be produced and the number of acceptable packets 2 of cigarettes actually produced, and the amount of packing material 5, 6, 7 left at feed stations 9*b*, 9*d*, 9*f* of packing machine 1 is determined cyclically.

As packing machine 1 is running, the amount of packing material 5, 6, 7 necessary to produce the outstanding number of packets 2 of cigarettes is determined cyclically, and the outstanding amount of packing material 5, 6, 7 to be loaded at feed stations 9*b*, 9*d*, 9*f* of packing machine 1 is determined cyclically as a function of the amount of packing material 5, 6, 7 necessary to produce the outstanding number of packets 2 of cigarettes, and the amount of packing material 5, 6, 7 left at feed stations 9*b*, 9*d*, 9*f* of packing machine 1. The outstanding amount of packing material 5, 6, 7 to be loaded at feed stations 9*b*, 9*d*, 9*f* of packing machine 1 is communicated cyclically to the operator in charge of procuring and supplying packing material 5, 6, 7, e.g. by means of a display device (not shown) of a user interface or HMI unit (not shown).

In this way, the operator in charge of procuring and supplying packing material 5, 6, 7 is kept constantly informed of the exact outstanding amount of packing material 5, 6, 7 to be loaded at feed stations 9*b*, 9*d*, 9*f* of packing machine 1, and can therefore schedule procurement and supply of packing material 5, 6, 7 accordingly.

Packing material 5, 6, 7 is normally stored and handled in units, each comprising a given amount of packing material 5, 6, 7. For example, sheets 5 of packing material and collars 7 are stored in reels (or groups of reels), and blanks 6 in stacks (or groups of stacks). Cyclically communicating the outstanding amount of packing material 5, 6, 7 to be loaded at feed stations 9*b*, 9*d*, 9*f* of packing machine 1 comprises rounding the outstanding amount of packing material 5, 6, 7 to be loaded at feed stations 9*b*, 9*d*, 9*f* of packing machine 1 up to a whole number of units of packing material 5, 6, 7, and communicating the rounded-up whole number of units of packing material 5, 6, 7 to the operator.

The outstanding amount of packing material 5, 6, 7 to be loaded at feed stations 9*b*, 9*d*, 9*f* of packing machine 1 is increased by a given percentage to allow for rejects. The reject-related percentage increase is initially a constant of packing machine 1, and may be real-time updated during manufacture of the current production lot.

The above control method obviously applies to any machine in the tobacco processing system, and may therefore be used on a cigarette manufacturing machine, a filter assembly machine, a cellophaning machine, a cartoning machine, or a boxing machine.

The invention claimed is:

1. A packing machine for packing a product in at least one sheet of packing material; the packing machine comprising:

at least two conveyors, each of which comprises at least two pockets movably positioned relative to the conveyors, the conveyors being arranged along a path and each pocket configured for receiving and conveying at least one respective product; and a number of transfer stations for transferring the products and each of the transfer stations situated between each conveyor and a following conveyor in the path;

wherein the pockets of each conveyor are divided into a first number (N1) of groups, each of the groups comprising an equal second number (N2), of at least two of the pockets;

wherein at each transfer station, a transfer device simultaneously transfers a second number (N2) of products from the respective pockets in a group of pockets on a releasing conveyor to the respective pockets in a group of pockets on a receiving conveyor; and wherein at least one conveyor comprises an actuating device for aligning, at least one transfer station, all the pockets in a group of pockets on the releasing conveyor, and all the pockets in a group of pockets on the receiving conveyor in a straight line by moving at least one pocket relative to the conveyor to which it is associated, so that the pocket is positioned in a given transfer position at the transfer station.

2. The packing machine of claim 1, wherein three products are transferred simultaneously from three pockets, respectively, with one being centrally located and two being lateral thereto, on the releasing conveyor to three pockets, respectively, with one being centrally located central and two being lateral thereto, being on the receiving conveyor.

3. The packing machine of claim 2, wherein only the lateral pockets are moved with respect to the relative conveyor to position each lateral pocket in a given transfer position at the transfer position at the transfer station.

4. The packing machine of claim 3, wherein the lateral pockets undergo two equal, opposite rotations with respect to the relative conveyor as they approach the transfer station.

5. A packing machine for packing a product in at least one sheet of packing material; the packing machine comprising:

at least two conveyors, each of which comprises at least two pockets, the conveyors being arranged along a path, with each pocket being configured for receiving and conveying at least one respective product; and a number of transfer stations for transferring the products; each of the transfer stations situated between each conveyor and a following conveyor in the path, wherein the pockets of each conveyor are divided into a first number (N1) of groups, each of the groups comprising an equal second number (N2), of at least two, of the pockets;

wherein at each transfer station, a transfer device simultaneously transfers a second number (N2) of products from the respective pockets in a group of pockets on a releasing conveyor, to the respective pockets in a group of pockets on a receiving conveyor; and wherein at least one conveyor is rotary, and comprises a drum rotating about a respective central axis to move the pockets along a circular path;

all the rotary conveyors rotate in steps about their respective central axes, to move the respective pockets along a respective circular path;

wherein all the rotary conveyors comprise the same first number (N1) of groups of pockets; and, at each step, all the rotary conveyors rotate by the same angle which is equal to a full turn of the rotary conveyor divided by the first number (N1).

6. The packing machine of claim 5, wherein at least one conveyor comprises an actuating device for aligning, at least one transfer station, all the pockets in a group of pockets on the releasing conveyor, and all the pockets in a group of pockets on the receiving conveyor in a straight line.

7. The packing machine of claim 6, wherein the pockets in a group of pockets on the releasing conveyor, and the pockets in a group of pockets on the receiving conveyor are aligned in a straight line by moving at least one pocket with respect to its conveyor, so that the pocket is positioned in a given transfer position at the transfer station.

8. The packing machine of claim 7, wherein three products are transferred simultaneously from three pockets, respectively, with one being centrally located and two being lateral thereto, on the releasing conveyor to three pockets, respectively, with one being centrally located and two being lateral thereto on the receiving conveyor.

9. The packing machine of claim 8, wherein only the lateral pockets are moved with respect to the relative conveyor to position each lateral pocket in a given transfer position at the transfer station.

10. The packing machine of claim 9, wherein the lateral pockets undergo two equal, opposite rotations with respect to the relative conveyor as the lateral pockets approach the transfer station.

11. The packing machine of claim 6, wherein at least one conveyor is rotary, and comprises a drum rotating about a respective central axis to move the relative pockets along a circular path.

12. The packing machine of claim 11, wherein the drum is polygonal, and comprises the first number (N1) of flat faces, each of which supports all the pockets in a group of pockets aligned with one another in a line parallel to the flat face.

13. The packing machine of claim 12, comprising a feed unit configured to simultaneously transfer a first number (N1) of products to the pockets in a group of pockets on an initial conveyor.

14. The packing machine of claim 13, wherein the feed unit comprises a second number (N2) of outlets, each of which is configured to transfer a product to a respective pocket on the initial conveyor.

15. The packing machine of claim 13, comprising an output unit which is configured to simultaneously receive a second number (N2) of products from the pockets in a group of pockets on a final conveyor.

16. The packing machine of claim 15, wherein the output unit comprises a second number (N2) of parallel output paths, each of which receives a product from a respective pocket on the final conveyor.

17. The packing machine of claim 12, for packing a group of cigarettes in an inner sheet of packing material and an outer sheet of packing material; the packing machine comprising:

a hopper having a second number (N2) of outlets;

a first forming belt shaped conveyor comprising a first number (N1) of groups of first pockets, each comprising a second number (N2) of first pockets;

a first transfer device for simultaneously transferring a second number (N2) of groups of cigarettes to the first pockets in a group of first pockets on the first forming conveyor;

a second drum shaped packing conveyor comprising a first number (N1) of groups of second pockets, each comprising a second number (N2) of second pockets;

a second transfer device for simultaneously transferring a second number (N2) of groups of cigarettes from the first pockets in a group of first pockets on the first forming conveyor to the second pockets in a group of second pockets on the second packing conveyor;

a third drum shaped packing conveyor comprising a first number (N1) of groups of third pockets, each comprising a second number (N2) of third pockets;

a third transfer device for simultaneously transferring a second number (N2) of groups of cigarettes from the second pockets in a group of second pockets on the second packing conveyor to the third pockets in a group of third pockets on the third packing conveyor;

a fourth belt shaped packing conveyor comprising a first number (N1) of groups of fourth pockets, each comprising a second number (N2) of fourth pockets;

a fourth transfer device for simultaneously transferring a second number (N2) of groups of cigarettes from the third pockets in a group of third pockets on the third packing conveyor to the fourth pockets in a group of fourth pockets on the fourth packing conveyor;

a drying unit having a second number (N2) of output paths; and a fifth transfer device for simultaneously transferring a second number (N2) of groups of cigarettes from the fourth pockets in a group of fourth pockets on the fourth packing conveyor to the output paths of the drying unit.

18. The packing machine of claim 17, wherein the drying unit comprises the second number (N2) of straight, parallel conveyor belts defining the output paths.

19. The packing machine of claim 17, and comprising a first feed device located along the periphery of the second packing conveyor to feed a first sheet of packing material to each second pocket on the second packing conveyor.

20. The packing machine of claim 19, wherein the first feed device simultaneously feeds a second number (N2) of first sheets of packing material to the second pockets in a group of second pockets on the second packing conveyor when the second pockets are stationary.

21. The packing machine of claim 20, wherein the first feed device comprises a second number (N2) of suction heads fitted to a movable member configured to move back and forth between a receiving position at a strip of first sheets of packing material, and a release position at the second packing conveyor.

22. The packing machine of claim 21, wherein each suction head is hinged to the movable member to rotate, with respect to the movable member, about an axis of rotation parallel to the axis of rotation of the drum of the second packing conveyor.

23. The packing machine of claim 17, and comprising a second feed device located along the periphery of the fourth packing conveyor to feed a second sheet of packing material to each fourth pocket on the fourth packing conveyor.

24. The packing machine of claim 23, wherein the second feed device simultaneously feeds a second number (N2) of second sheets of packing material to the fourth pockets in a group of fourth pockets on the fourth packing conveyor when the fourth pockets are stationary.

25. The packing machine of claim 24, wherein the second feed device comprises a second number (N2) of insertion heads configured to move back and forth to simultaneously insert a second number (N2) of second sheets of packing material, positioned in a feed position in front of the insertion heads, into the fourth pockets of a group of fourth pockets on the fourth packing conveyor.

26. The packing machine of claim 25, wherein the second feed device comprises a second number (N2) of conveying devices, each of which rotates in steps about an axis of rotation to withdraw a second sheet of packing material from a line supplying the second sheets of packing material, and to position the second sheet of packing material in a feed position in front of a respective insertion head.

27. The packing machine of claim 26, wherein each conveying device rotates in steps in the same direction at all times, and rotates 360.degree. at each step.

28. The packing machine of claim 6, wherein two conveyors are rotary, and each comprises a drum rotating about a respective central axis to move the relative pockets along a circular path.

29. The packing machine of claim 5, for packing a group of cigarettes in an inner sheet of packing material and an outer sheet of packing material; the packing machine comprising:

a hopper having the second number (N2) of outlets; a first forming drum shaped conveyor, comprising the first number (N1) of groups of first pockets, each group comprising the second number (N2) of first pockets;

a first transfer device for simultaneously transferring a second number (N2) of groups of cigarettes to the first pockets in a group of first pockets on the first forming conveyor;

a second drum shaped packing conveyor comprising the first number (N1) of groups of second pockets, each comprising the second number (N2) of second pockets;

a second transfer device for simultaneously transferring the second number (N2) of groups of cigarettes from the first pockets in a group of first pockets on the first forming conveyor to the second pockets in a group of second pockets on the second packing conveyor;

a third drum shaped packing conveyor comprising the first number (N1) of groups of third pockets, each comprising the second number (N2) of third pockets;

a third transfer device for simultaneously transferring the second number (N2) of groups of cigarettes from the second pockets in a group of second pockets on the second packing conveyor to the third pockets in a group of third pockets on the third packing conveyor;

a fourth drum shaped packing conveyor comprising a first number (N1) of groups of fourth pockets , each comprising a second number (N2) of fourth pockets;

a fourth transfer device for simultaneously transferring a second number (N2) of groups of cigarettes from the third pockets in a group of third pockets on the third packing conveyor to the fourth pockets in a group of fourth pockets on the fourth packing conveyor;

a drying unit having the second number (N2) of output paths; and a fifth transfer device for simultaneously transferring the second number (N2) of groups of cigarettes from the fourth pockets in a group of fourth pockets on the fourth packing conveyor to the output paths of the drying unit.

30. The packing machine of claim 29, wherein the drying unit comprises the second number (N2) of straight, parallel conveyor belts defining the output paths.

31. The packing machine of claim 29, and comprising a first feed device located along the periphery of the second packing conveyor to feed a first sheet of packing material to each second pocket on the second packing conveyor.

32. The packing machine of claim 29, wherein the first feed device feeds one first sheet of packing material to one second pocket on the second packing conveyor when the second pocket is moving and is traveling past the first feed device.

33. The packing machine of claim 29, and comprising a second feed device located along the periphery of the fourth packing conveyor to feed a second sheet of packing material to each fourth pocket on the fourth packing conveyor.

34. The packing machine of claim 33, wherein the second feed device feeds one second sheet of packing material to one fourth pocket on the fourth packing conveyor when the fourth pocket is moving and is traveling past the second feed device.

* * * * *